United States Patent [19]

Berger

[11] 3,930,986

[45] Jan. 6, 1976

[54] HIGH OCTANE MOTOR FUEL PRODUCTION

[75] Inventor: Charles V. Berger, Western Springs, Ill.

[73] Assignee: Universal Oil Products Company, Des Plaines, Ill.

[22] Filed: Dec. 23, 1974

[21] Appl. No.: 536,048

Related U.S. Application Data

[63] Continuation-in-part of Ser. No. 405,251, Oct. 10, 1973, Pat. No. 3,867,276, which is a continuation-in-part of Ser. No. 237,776, March 24, 1972, abandoned.

[52] U.S. Cl. ..... 208/60; 208/111

[51] Int. Cl.[2] ..... C10G 37/10

[58] Field of Search ..... 208/60, 65, 111

[56] References Cited

UNITED STATES PATENTS 3,385,781 5/1968 Hamner et al. ..... 208/111

FOREIGN PATENTS OR APPLICATIONS 1,108,667 4/1968 United Kingdom ..... 208/60

*Primary Examiner*—Herbert Levine

*Attorney, Agent, or Firm*—James R. Hoatson, Jr.; Thomas K. McBride; William H. Page, II

[57] ABSTRACT

An improved combination process for the production of an unleaded, narrow boiling range, high octane motor fuel which involves (1) a novel form of low-severity hydrocracking followed by (2) catalytic reforming wherein the exothermic conversion in the hydrocracking zone is controlled by adjusting the hydrocracking reaction zone pressure. The process is effected without the intermediate separation of the product effluent from the low-severity hydrocracking zone, and therefore, provides a true "in-line" hydrocracking/reforming combination process.

7 Claims, 1 Drawing Figure

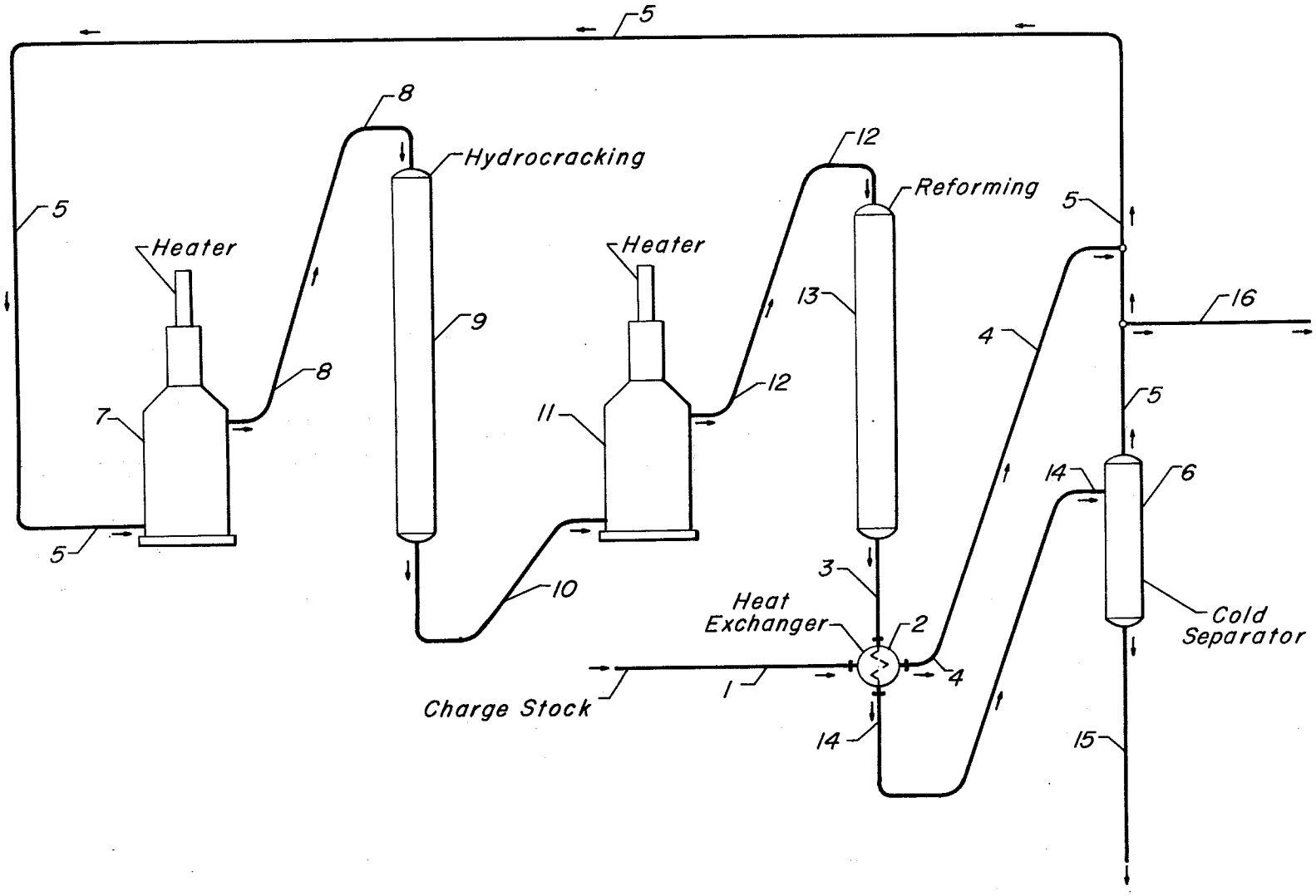
Cold Separator
Reforming
Heat Exchanger
Charge Stock
Hydrocracking
Heater
Heater
1
2
3
4
5
6
7
8
9
10
11
12
13
14
15
16

HIGH OCTANE MOTOR FUEL PRODUCTION

RELATED APPLICATIONS

The present invention is a continuation-in-part of my copending application, Ser. No. 405,251, filed Oct. 10, 1973 now U.S. Pat. No. 3,867,276 which in turn is a continuation-in-part of my application Ser. No. 237,776, filed Mar. 24, 1972, now abandoned, all the teachings of which copending applications are incorporated herein by specific reference thereto.

The present invention is directed toward a multiple-stage combination process for the conversion of naphtha, or gasoline boiling range hydrocarbons, into a high octane motor fuel which does not require the addition of metallic components —i.e., lead compounds—to enhance the anti-knock characteristics thereof. Although aromatic hydrocarbons, principally benzene, toluene and the various xylene isomers, are required in large quantities to satisfy the demand for a wide variety of petrochemicals, a principal utilization thereof is as gasoline blending components in the production of a high octane motor fuel. Benzene has a clear research octane blending value of about 99, while the more abundant toluene and other aromatics have a value in excess of about 100; they are, therefore, the predominant octane-improvers in a refinery gasoline pool. One well-known and well-documented refining process, capable of providing significant improvement in the octane rating of naphtha boiling range fractions, is the catalytic reforming process. In such a process, the principal octane-improving reactions are naphthene dehydrogenation, naphthene dehydroisomerization, paraffin dehydrocyclization and paraffin hydrocracking. Naphthene dehydrogenation is an extremely rapid reaction constituting the principal octane improving reaction. With respect to a five-membered ring alkyl naphthene, it is first necessary to effect isomerization to produce a six-membered ring naphthene, followed by the dehydrogenation thereof to an aromatic hydrocarbon. Paraffin aromatization is achieved through the dehydrocyclization of straight-chain paraffins having at least six carbon atoms per molecule. This latter reaction is limited in view of the fact that the aromatic concentration increases as the charge stock traverses the reforming reaction zones, thereby decreasing the rate of additional dehydrocyclization. Unreacted, relatively low octane paraffins, principally comprising pentanes and hexanes, are, therefore, present in the reformed product effluent and effectively reduce the overall octane rating thereof. Currently, these components can be tolerated in view of their comparatively high lead susceptibility.

Relatively recent investigations into the causes and cures of environmental pollution have indicated that more than half the violence perpetrated upon the atmosphere stems from vehicular exhaust consisting primarily of unburned hydrocarbons and carbon monoxide. These investigations have resulted in the development of various catalytic converters which, when installed within the exhaust system, are capable of converting more than 90% of the noxious components. During the development of these catalytic converters, it was learned that the efficiency of conversion and stability of the selected catalytic composites were severely impaired when the exhaust fumes resulted from the combustion of lead-containing motor fuel. Therefore, it has been recognized throughout the petroleum industry, as well as in major gasoline-consuming countries, that suitable motor fuels must ultimately be produced for consumption in current internal combustion engines without requiring the addition of lead-containing, ecologically-deleterious compounds.

It has also been observed recently that a narrow boiling range motor fuel, consisting almost exclusively of $C_5$-$C_8$ hydrocarbons, with only minor quantities of $C_4$-$C_9$ (and heavier), would have certain advantages in reducing the emmission of unburned hydrocarbons into the atmosphere. Currently-marketed gasolines have a much broader boiling range, particularly with respect to the high-boiling end. One of the principal objects of my invention is to offer an efficient process for producing a highly desirable narrow-boiling range motor fuel. It is also being recognized that unburned hydrocarbons and carbon monoxide are not the only dangerous pollutants being discharged via vehicular exhaust. The possibility that lead compounds emitted in exhaust gases contributes to lead poisoning has resulted in appropriate legislation, enacted in some countries, to reduce significantly the quantity of lead permitted in motor fuel.

One natural consequence of the removal of lead, in addition to others, resides in the fact that petroleum refining techniques will necessarily experience modification in order to produce the required voluminous quantities of a high octane, unleaded motor fuel, in an economically attractive fashion. With respect to a high-severity catalytic reforming system, paraffinic hydrocarbons are subjected to, and undergo cracking. Although this partially increases the octane rating of the gasoline boiling range product, substantial quantities of normally gaseous material are produced. At a relatively low reforming severity, paraffin cracking is decreased with the result that an increased quantity of low octane rating saturates is produced. In order to upgrade the overall quality of the gasoline, either the addition of lead becomes necessary, or the low octane rating saturates must be subjected to further processing to produce higher octane components. As previously stated, additional processing of the saturates can be eliminated by increasing the severity of operation within the catalytic reforming reaction zone. This type of operation produces a two-fold effect, notwithstanding an increase in the final octane rating of the ultimate product; first, additional high octane aromatic components are produced and, secondly, the low octane components are at least partially eliminated by conversion either to aromatic hydrocarbons, or to light normally gaseous material. The end result includes a lower liquid yield of motor fuel due both to "shrinkage" in molecular size, and to the production of the aforesaid light gaseous components.

Such problems attendant the production of a high octane, unleaded motor fuel, are eliminated through the utilization of the present combination process. The application of the present process is by no means limited to the production of lead-free gasoline, but is also advantageous for leaded gasolines as well. As hereinafter indicated in greater detail, the novel hydrocracking zone characteristically retains most of the rings present in the feed, albeit with fewer side chain carbon atoms. Thus, the integrity of the cyclic structure of alkyl aromatics can be largely preserved while producing isomeric paraffins from the side chain components. Of course, the extent of ring retention is a function of the extent of hydrocracking, so that a degree of freedom exists with regard to this aspect of the invention.

Hydrocarbonaceous charge stocks, contemplated for conversion in accordance with the present invention, constitute naphtha boiling range hydrocarbon fractions and/or distillates. "Gasoline boiling range hydrocarbons" generally connotes those hydrocarbons, usually devoid of pentane and lighter material, having an initial boiling point of at least about 100°F., and an end boiling point less than about 450°F., and is inclusive of intermediate boiling range fractions often referred to in the art as "light naphtha" and "heavy naphtha". However, it is not intended to limit the present invention to a charge stock having a particular boiling range. Suffice to say, a suitable charge stock will generally have an initial boiling point above about 100°F. and an end boiling point below about 450°F. During the selective hydrocracking step, the charge stock is reduced in boiling range; consequently, a charge stock having a substantially higher boiling range may be successfully processed to yield a suitable charge stock for the catalytic reforming step. The precise boiling range of any given naphtha fraction will be dependent upon the economic and processing considerations which are prevalent in the particular locale where such a charge stock is available. A key feature of the present invention resides in a combination of hydrocracking and catalytic reforming in which (1) alkyl side chains on aromatic hydrocarbons are reduced and cracked to useful components, (2) higher molecular weight paraffins are cracked into more highly branched, lower boiling material and (3) the ring structure of both naphthenes and aromatics is largely preserved so that the catalytic reforming operation will result in exceptional product quality and volumetric yield.

It must be acknowledged that the prior art contains references to the hydrocracking of hydrocarbon fractions followed by the catalytic reforming of a portion of the hydrocracked product effluent. The distinct feature of my invention, however, is contrary and resides in the utilization of a compatible catalyst system in which the operating conditions of pressure, hydrogen recycle and contaminant level are such that a true series-flow from hydrocracking to catalytic reforming is afforded. That is, the combination may be maintained in a completely integrated fashion without the necessity for the separation of gaseous and/or liquid phases intermediate the two systems. According to the prevalent prior art preferential practice, hydrocracking is best conducted at significantly higher pressures than catalytic reforming — e.g., 1,000–3,000 psig. vs. 100–700 psig. Applicable prior art further teaches the requirement of independent control of contaminant levels. Thus, hydrocracking systems require, or are enhanced by a high hydrogen sulfide level in a reaction system for some catalysts, or a high hydrogen chloride level for other catalysts. The latter type of catalyst is also generally intolerant of water at any level; thus, there exists a need for water elimination from the feed stock. Conversely, catalytic reforming operations generally require the presence of water and/or hydrogen chloride at only some few parts per million, and usually prefer the substantially complete prior elimination of sulfurous compounds. The prior art does not, therefore, disclose the essentials of the present invention which is the compatibility of the two catalysts to the same pressure level and reaction atmosphere.

The essence of the present invention resides in the "in-line" processing afforded by the integrated compatibility of the entire system. There is no intermediate separation of the effluent from the first, hydrocracking reaction zone, but rather the introduction of the total product effluent thereform into the catalytic reforming zone. Thus, there is necessitated only a single separation system, that following catalytic reforming, therefore eliminating one entire system involving cooling, condensing, high-pressure separation, compression and hydrogen recycle. Typical of the diametrically-opposed prior art hereinbefore described, and wherein intermediate separation is effected between the two reaction zones, is the multiple-stage process delineated in British Pat. No. 1,108,667 (Int. Cl. C-10g 37/10). Throughout the specification, and especially with reference to the accompanying drawing, there is disclosed a two-stage system in which each reaction zone possesses its own heating, reacting, cooling and condensing equipment. More importantly, it is required that each reaction system have a separate recycle gas system integrated therewith. There exists, therefore, no awareness of the catalytic compatibility which permits a single system of cooling, condensing, separation and compressive hydrogen recycle.

Another feature of the present invention, not found in prior art combination processes, resides in the reduction of the molecular weight of aromatic hydrocarbons. The prior art has disclosed the concept of selectively cracking normal paraffins from a reformed product effluent without disturbing aromatic molecular weight. In another type of processing, the molecular weight of the aromatics is reduced by the utilization of extremely inefficient demethylation, resulting in a decreased liquid volumetric yield. In the present process, the alkyl side chains are selectively converted to $C_3$, $C_4$ and $C_5$ hydrocarbons before reforming without substantial loss of the ring structure itself, so that the overall liquid hydrocarbon yield is high.

Yet another feature of the present invention is the method of maintaining the overall exothermic temperature increase in the hydrocracking reaction zone at a relatively high value while preventing a run-away exothermic reaction, which method comprises adjusting the hydrocracking reaction zone pressure in response to the prevailing temperature conditions therein.

A principal object of the present invention is to afford the production of a high octane, unleaded, or low leaded motor fuel. A corollary objective is to produce an aromatic-rich, normally liquid motor fuel product heavily concentrated in high octane rating isoparaffins.

A specific object is to provide an improved combination process for the production of an unleaded, narrow boiling range high octane motor fuel through the use of a low-severity hydrocracking system followed by catalytic reforming, which process is effected without the intermediate separation of the product effluent from the low-severity hydrocracking zone, wherein the conversion in the hydrocracking zone is controlled by adjusting the hydrocracking reaction zone pressure.

Therefore, in a broad embodiment, my invention encompasses a process for the production of a high octane rating motor fuel which comprises the steps of: (a) reacting a naphtha boiling range charge stock with hydrogen, in a first reaction zone, at conditions, including a pressure below about 700 psig, selected to convert long-chain paraffins into lower-boiling isoparaffins; (b) reacting the resulting first zone effluent, without intermediate separation thereof, in a second reaction zone, at catalytic reforming conditions, including a pressure below about 700 psig., selected to convert naphthenic hydrocarbons into aromatics; and, (c) recovering said high octane rating motor fuel from the resulting second zone effluent, wherein the conversion in the hydrocracking zone is controlled by adjusting the hydrocracking reaction zone pressure.

In a more specific embodiment, the present invention is directed toward a process for the production of a high octane motor fuel which comprises the steps of: (a) hydrocracking naphtha boiling range hydrocarbons containing cyclic components, including aromatics, with hydrogen, in a first reaction zone, in contact with a first catalytic composite of a Group VIII noble metal component and a zeolitic aluminosilicate carrier material and at a temperature in the range of about 350°F. to about 800°F. and a pressure from about 100 to about 700 psig. which is conducted adiabatically and has a marked propensity for a high temperature run-away; (b) reacting the resulting first reaction zone effluent without intermediate separation thereof, in a second reaction zone, in contact with a second catalytic composite comprising platinum and alumina, at a temperature in the range of about 800°F. to about 1100°F. and at a pressure of from about 100 to about 700 psig.; and, (c) recovering said high octane motor fuel from the resulting second reaction zone effluent; the method of maintaining the over-all exothermic temperature increase in said first reaction zone at a relatively high value while preventing a run-away exothermic reaction, which method comprises: (1) employing a first reaction zone inlet temperature generally below the hydrocracking range but sufficient to promote exothermic hydrogenation of aromatics so that the induced temperature increase initiates a favorable hydrocracking rate; and, (2) employing a first reaction zone outlet pressure favoring sufficient endothermic dehydrogenation of naphthenes to aromatics to prevent a run-away hydrocracking situation.

Other embodiments of my invention involve the composition of the catalytic composites, operating conditions and various processing techniques. In one such other embodiment, the zeolitic crystalline aluminosilicate carrier material comprises mordenite having a silica to alumina mole ratio from about 12.0 to about 30.0.

As hereinabove set forth, the present invention constitutes an improved combination process for the production of a high octane, unleaded, or low leaded motor fuel. A key feature of this combination process is a true series-flow system between the initial hydrocracking zone and the subsequent catalytic reforming zones; that is, the hydrocracking product effluent is utilized as the charge to the catalytic reforming zone without any intermediate separation thereof. The naphtha boiling range charge stock to the hydrocracking reaction zone may be obtained from a multitude of sources. For example, one suitable source constitutes the naphtha distillate derived from a full boiling range petroleum crude oil; another source is the naphtha fraction obtained from the catalytic cracking of gas oil, while still another source constitutes the gasoline boiling range effluent from a hydrocracking reaction zone which processes heavier-than-gasoline charge stocks. In view of the fact that the greater proportion of such naphtha fractions are contaminated through the inclusion of sulfurous and nitrogenous compounds, as well as olefinic hydrocarbons, it is contemplated that such contaminants will be removed by conventional hydrorefining before the charge stock is supplied to the hydrocracking reaction zone. Details of hydrorefining processes are well known and thoroughly described in the prior art. It is understood that such pretreatment of the naphtha charge stock is not a novel feature of the present combination process.

The hydrocracking reaction zone is unlike present-day hydrocracking processes, both in function and result. Initially, the charge to the hydrocrackinig reaction zone is a naphtha boiling range stock, and the net product effluent contains very little normally gaseous material such as methane and ethane. That normally gaseous material present in the recycled hydrogen-rich vaporous phase will, of course, be present in the effluent. Through the utilization of a particular catalytic composite and operating conditions, the integrity of cyclic rings is largely maintained, and the cracking of paraffinic hydrocarbons results primarily in low molecular weight isoparaffins. In view of the unique character of the product effluent, being exceedingly rich in isoparaffins, with respect to the total paraffin content, the present hydrocracking reaction zone is referred to herein as "I-cracking". The selective nature of the hydrocracking reactions taking place include the retention of cyclic rings and the reduction in molecular weight thereof, via isomerization and the splitting of isoparaffins from the parent molecule. Thus, cyclic compounds boiling in the higher temperature range of the feed stock are converted to lower-boiling naphthenes and aromatics; in the subsequent catalytic reforming reaction zone, the naphthenes are dehydrogenated into gasoline boiling range aromatics while the aromatics in the hydrocracked product effluent are retained intact. Beneficial effects are thus afforded since high octane aromatic hydrocarbons are more uniformly distributed throughout the final gasoline boiling range.

Another key feature of this combination process is the ability to maintain the over-all exothermic temperature increase in the hydrocracking reaction zone at a relatively high value while preventing a run-away exothermic reaction by adjusting the reaction zone pressure in response to the prevailing temperature conditions therein.

It is conventional in fixed-bed catalytic hydrocracking processes to obtain as long a run length as possible by initiating the run at a relatively low temperature, and compensating for catalyst deactivation during the run by gradually increasing the hydrocracking temperature. This procedure is advantageous in that the quality of the gasoline product varies considerably over the run length. One of the advantages of the present process is that the entire run can if desired be operated at substantially the same average bed temperature, while compensating for catalyst deactivation by incrementally increasing the reaction zone pressure. Conventional hydrocracking processes also employ interstage quenching, as with cool hydrogen, to prevent exothermic runaways. This quenching technique adds considerably to the capital and operating expense of the process. For example, some local construction codes for high pressure reactor shells require heavier side walls for a given service if side nozzles for quench fluid injection are required along the length of the reactor, and the side nozzles themselves are an expensive item. By using variable pressure to moderate the activity of the catalyst, instead of massive quantities of fluid quench media, side nozzles may be entirely eliminated.

Additional benefits may also be derived from a hydrocracking process utilizing pressure as a process variable because, for example, if it is desired to increase hydrocracking and reduce aromatization, the reaction zone pressure could be raised. A reduction in pressure would reduce hydrocracking and increase aromatization. A temperature increase would increase both hydrocracking and aromatization, while a decrease would accomplish a reduction in both reactions.

Recognition of the fact that an increase in pressure increases hydrocracking and reduces aromatization and, conversely a decrease in pressure increases aromatization and decreases hydrocracking has proved to be useful in controlling adiabatic hydrocracking reactions. Hydrocracking is a highly exothermic chemical reaction while aromatization is a highly endothermic chemical reaction. Since hydrocracking is highly exothermic, it is difficult to operate a hydrocracking reaction zone isothermally because there is no practical method for removing the generated heat as fast as it is created. Therefore, most catalytic hydrocracking reaction zones are permitted to operate in an adiabatic manner. One of the first problems encountered in the operation of an adiabatic hydrocracking reaction zone is the control of the temperature profile within the reaction zone. The temperature at the inlet of the reaction zone must be increased sufficiently to initiate the desired hydrocracking and once the hydrocracking reaction begins, adjustment of the inlet temperature has no influence on the reactants which have passed the inlet and are continuing to generate heat. Of course, if the inlet temperature is decreased the cooler wave of reactants passing through the reaction zone will definitely and ultimately control the temperature but the lower temperature will preclude the desired reaction of the reactants which is the ultimate goal of the entire scheme. Again considering the reactants which have passed the inlet of the reaction zone and which are generating more heat in an adiabatic environment, it is recognized that the increase in the temperature of the reactants will accelerate the reaction rate, thereby, creating even more heat. This uncontrolled and continual generation of heat cannot be tolerated because of probable damage to the catalyst and/or the vessels which contain the reaction zone. If the hydrocracking reaction zone temperature cannot be controlled at a temperature high enough to perform the desired conversion while maintaining downstream temperature control, the ultimate goal is thwarted. I have discovered that when there is a continuous generation of heat and increase of the reactants temperature, a decrease of the reaction zone pressure will be immediately seen by all of the reactants within the reaction zone, regardless of the distance from the reaction zone inlet, which will tend to decrease the elevated reaction zone temperatures by slowing the hydrocracking reaction rate and by increasing the aromatization reaction rate. Conversely, I have discovered that when a desired reaction zone inlet temperature is reached or no higher inlet temperature may be realized because of equipment limitation, the desired hydrocracking reactions may be performed and controlled by increase of the reaction zone pressure which will tend to increase hydrocracking and decrease aromatization. By adjusting the hydrocracking reaction zone pressure and inlet temperature, the desired balance of reactions can therefore be obtained.

The conversion conditions employed in the hydrocracking reaction zone include a liquid hourly space velocity of about 0.5 to about 100, a hydrogen circulation rate of from about 1 to about 20 moles per mole of feed, a pressure of from aboout 100 to about 700 psig. and a maximum catalyst bed temperature in the range of about 350° to about 800°F. In most instances, the maximum catalyst bed temperature will be in the range of about 600°F. to about 750°F.

The catalytic composite disposed in the hydrocracking reaction zone of the present combination process comprises a Group VIII noble metal component combined with a porous carrier material, either amorphous, or zeolitic in nature, and preferably siliceous; a particularly preferred carrier material comprises the crystalline aluminosilicate generally known as mordenite. Suitable carrier materials may be selected from the group of amorphous refractory inorganic oxides including alumina, silica, titania, zirconia, mixtures thereof, etc., or from zeolitic, aluminosilicate materials such as faujasite, mordenite, Type A or Type U molecular sieves, or zeolitic material which is combined with an amorphous matrix. As abovenoted, a Group VIII noble metal component comprises an element of hydrocracking catalyst. Suitable metals are those from the group of platinum, palladium, rhodium, ruthenium, osmium and iridium, as well as mixtures thereof. Of these, a palladium, or platinum component is especially preferred in view of the increased propensity to maintain the cyclic structure. The noble metal will be combined with the carrier material in an amount of about 0.01% to about 2.0% by weight, calculated as the elemental metal. Mordenite, the preferred carrier material, from the standpoint of converting normal paraffins into the isomeric counterparts, may be employed in and of itself; generally, however, the carrier material is amorphous alumina with the mordenite being in the range of about 1.0% to about 75.0%. The utilization of this specific hydrocracking/reforming combination permits a common recycle gas system. It further permits the catalytic reforming zone to function at relatively low-severity conditions.

As hereinabove set forth, the catalytic composite disposed within the hydrocracking reaction zone utilizes a mordenite-containing carrier material for a palladium, or platinum component. Mordenite is a highly siliceous zeolitic crystalline aluminosilicate which, as naturally-occurring, or synthetically-prepared, has a silica to alumina mole ratio in the range of about 6 to about 12. The crystalline structure of mordenite consists of four- and five-membered rings of silicon and aluminum tetrahedra arranged to form channels, or tubes running parallel to the axis of the crystal. Being parallel, these channels do not intersect with the result that they may be entered only at the ends thereof. Such a channel-type structure is unique to mordenite among the many zeolites, and the mordenite structure is often termed "two-dimensional" in contrast to other zeolitic materials, such as faujasite, in which the cages may be entered from three directions. The conventional silicon to aluminum mole ratio of 6 to about 12 may be increased to as high as 50 or more by acid-leaching alumina from the mordenite, while simultaneously preserving the characteristic mordenite crystal structure. Although substantially pure mordenite may be employed in the carrier material for the hydrocracking reaction zone, the preferred technique utilizes a mordenite crystal structure contained in amorphous alumina which is fixed in combination therewith in an amount in the range of about 25.0% to about 99.0% by weight.

The hydrocracking catalytic composite is prepared by initially forming the mordenite component having a silica/alumina mole ratio of about 12 to about 30, and preferably from about 15 to about 25. This is in contrast to conventional mordenite which commonly has a silica to alumina mole ratio in the range of about 6 to about 12. An amorphous silica-alumina composite is utilized as the starting material, and one particularly suitable source thereof is amorphous cracking catalyst containing about 13.0% by weight of alumina. The mordenite is typically manufactured by a process involving several steps, one of which is the formation of an acidic silica sol via the acidification of an aqueous sodium silicate solution. Other steps in the manufacture of the cracking catalyst include gelation of the silica sol, subsequent adjustment of the pH of the resulting slurry to about 3.5, followed by impregnation with an alumina sol using an aqueous aluminum sulfate solution. The aluminum sulfate is thereafter hydrolyzed and precipitated. The silica-alumina product from the above steps is slurried with water and spray-dried to yield fine silica-alumina microspheres suitable as the starting material for the manufacture of the mordenite component of the catalyst employed in the combination process of the present invention.

Regardless of the origin of the amorphous silica-alumina starting material, the same is heated in admixture with an aqueous alkali metal solution, for example, sodium hydroxide, at a temperature in the range of about 275°F. to about 480°F. The solution has an alkali metal concentration sufficient to provide an alkali metal/aluminum weight ratio from about 1.5 to about 3.5 within the reaction mixture. Yields of zeolites in the range of 90.0% to about 100.0% may be obtained after the stirred reaction mixture has been heated for a period from about 8 to about 24 hours. The resulting zeolite has a silica/alumina mole ratio substantially the same as the amorphous silica-alumina starting material.

Although it is understood that no precise method of manufacturing the mordenite component is essential to my invention, it is preferred to convert the resulting sodium form to the hydrogen form by conventional ion-exchange techniques. Conversion of the sodium form to the hydrogen form is achieved either by the direct replacement of sodium ions with hydrogen ions, or by the replacement of sodium ions with ammonium ions, followed by decomposition of the ammonium form by way of calcination at an elevated temperature. At least about 95.0%, and preferably at least about 99.0% of the alkali metal is removed by the ion-exchange technique.

The noble metal component, and especially palladium, or platinum may be incorporated within the catalytic composite in any suitable manner including ion-exchange or impregnation. The latter constitutes a preferred method, and utilizes water-soluble compounds of the noble metal component. Thus, the mordenite-containing carrier material may be impregnated with an aqueous solution of ammonium chloropalladate, chloropalladic acid, palladic chloride, hydrated palladium nitrate or the corresponding platinum compounds, etc. Following impregnation, the carrier material is dried at a temperature in the range of about 200°F. to about 400°F., and subsequently subjected to a calcination, or oxidation technique at an elevated temperature in the range of about 900°F. to about 1200°F.

Prior to its use, the catalytic composite may be subjected to a substantially water-free reduction technique. This is designed to insure a more uniform and thorough dispersion of the metallic components throughout the carrier material. Substantially pure and dry hydrogen is employed as the reducing agent at a temperature of about 800°F. to about 1200°F., and for a time sufficient to reduce the metallic component. In the present specification, as well as the appended claims, the use of the term Group VIII noble metal component is employed generically to encompass the existence of the metal in the elemental state, or in some combined form such as an oxide, sulfide, chloride, etc.

In view of the fact that the reactions being effected within the hydrocracking reaction zone are exothermic in nature, an increasing temperature gradient will be experienced as the hydrogen and charge stock traverse the catalyst bed. In accordance with the present process, the maximum catalyst bed temperature, virtually the same as that measured at the outlet of the catalytic reaction zone, is maintained in the aforesaid range of from about 350°F. to about 800°F., and preferably from about 600°F. to about 750°F. In order to assure that the catalyst bed temperature does not exceed the maximum selected limit, the use of reaction zone pressure as a process variable, is contemplated. The total product effluent from the I-cracking reaction zone, without any intermediate separation thereof, is introduced into the catalytic reforming reaction zone.

Catalytic composites, suitable for utilization in the reforming reaction zone, generally comprise a refractory inorganic oxide carrier material containing a metallic component selected from the noble metals of Group VIII. Recent developments in the area of catalytic reforming have indicated that catalyst activity and stability are significantly enhanced through the addition of various modifiers, and especially tin, rhenium, nickel, and/or germanium. Suitable porous carrier materials include the amorphous refractory inorganic oxides such as alumina, silica, zirconia, etc., and various crystalline aluminosilicates or combinations or alumina and/or silica with the various crystalline aluminosilicates. Generally favored metallic components include ruthenium, rhodium, palladium, osmium, rhenium, platinum, iridium, germanium, nickel, tin, and mixtures thereof. A preferred catalytic composite constitutes alumina and a platinum component in a concentration ranging from about 0.01% to about 5.0% by weight, and preferably from about 0.01% to about 2.0% by weight, calculated as the elemental metal. Reforming catalysts, suitable for utilization in the present combination process, may also contain combined halogen selected from the group of chlorine, fluorine, bromine, iodine and mixtures thereof.

Effective reforming operating conditions include catalyst temperatures within the range of about 800°F. to about 1100°F., preferably having an upper limit of about 1050°F. The liquid hourly space velocity, defined as volumes of hydrocarbon charge per hour per volume of catalyst disposed within the reforming reaction zone, is preferably within the range of about 1.0 to about 5.0, although space velocities from about 0.5 to about 15.0 may be employed. The quantity of hydrogen-rich gas, in admixture with the hydrocarbon feed stock, is generally from about 1.0 to about 20.0 moles of hydrogen per mole of normally liquid hydrocarbons. Pressures in the range of about 100 to about 700 psig. are suitable for effecting catalytic reforming reactions. However, since the present combination process is effected in true series-flow fashion, the reforming zone pressure will be somewhat less than that imposed upon the hydrocracking reaction zone, allowing for the pressure drop normally experienced as a result of fluid flow through the system, or at some intentionally reduced pressure level—i.e., from about 100 psig. to about 300 psig. The reforming reaction zone effluent is introduced into a high-pressure separation system at a temperature of about 60°F. to about 140°F., to separate lighter components from heavier, normally liquid components. Since normal reforming operations produce large quantities of hydrogen, a certain amount of gaseous stream is removed from the reforming system by way of pressure control, the remaining hydrogen-rich gaseous phase being recycled to combine with the charge to the hydrocracking reaction zone.

The inventive concept, encompassed by the present process, is illustrated in the accompanying drawing. Miscellaneous appurtenances, not believed necessary for a completely clear understanding of the present combination process, have been eliminated. The use of details such as pumps, compressors, instrumentation and controls, heat-recovery circuits, miscellaneous valving, start-up lines and similar hardware, etc., is well within the purview of those skilled in the petroleum refining art. Similarly, with respect to the flow of materials throughout the system, only those major streams required to illustrate the interconnection and interaction of the reaction zones are presented. Thus, recycle lines, quench streams, and vent gas streams have also been eliminated.

With reference now to the drawing, it will be described in conjunction with a commercially-scaled unit designed to process a principally heptane-plus, straight-run naphtha fraction which has previously been subjected to a hydrorefining technique for desulfurization, denitrification and olefin saturation. Pertinent properties of this naphtha fraction are presented in the following Table I:

TABLE I

| Charge Stock Properties | |
|---|---|
| Specific Gravity | 0.759 |
| 100 ml. Distillation, °F. | |
| I.B.P. | 210 |
| 10% | 230 |
| 30% | 244 |
| 50% | 262 |
| 70% | 286 |
| 90% | 318 |
| End Point | 369 |
| Hydrocarbon Type, vol.% | |
| Paraffins | 48.5 |
| Naphthenes | 41.4 |
| Aromatics | 10.1 |

Apparent to those having skill in the art of catalytic reforming, is the fact that this charge stock constitutes a suitable feed for present-day reforming systems. However, normally-conducted catalytic reforming, or those variants which practice selective cracking of the reformed product effluent, result in a final product containing substantial amounts of $C_9$, $C_{10}$ and $C_{11}$ aromatics, resulting in ASTM distillation end points approaching 400°F. Although this constitutes a suitable motor fuel gasoline for current requirements, it will not have the more narrow boiling range characteristics made possible through the use of the present invention.

The heavy naphtha charge stock is introduced into the process via line 1 and passes into heat-exchanger 2 where the temperature thereof is increased by suitable heat-exchange with the reformed product effluent in line 3. The charge stock continues through line 4, is admixed with a hydrogen-rich recycle gaseous phase in line 5, the source of which is hereinafter described, and the temperature is further increased in heater 7.

The heated charge stock/hydrogen mixture passes through line 8 into hydrocracking reaction zone 9 at a temperature such that the maximum catalyst bed temperature therein is about 680°F. Other operating conditions include a liquid hourly space velocity of about 8, a hydrogen to charge stock mole ratio of about 10.0:1.0 and an imposed pressure of about 260 psig. which pressure has been selected to produce a desired product and which pressure is adjusted during operation to effectively control the exothermic temperature increase at a high value while preventing a runaway exothermic reaction. The catalytic composite disposed in hydrocracking reaction zone 9 constitutes an alumina carrier material, having 25% by weight of mordenite associated therewith, and about 0.75% by weight of a platinum component, calculated as the elemental metal. The product effluent is withdrawn via line 10, and is introduced thereby into heater 11. Analyses thereof indicate that only about 0.2% by weight of the charge to reaction zone 9 is converted into methane and ethane. Furthermore, of the 13.5% by volume butanes, 75% is isobutane; of the 10.2% pentanes, 75% is isopentane; and, of the 5.5% hexanes, approximately 80.0% constitutes isohexanes; the total cyclic content has increased to 58% of the hexane-plus fraction, from the 51.5% in the fresh feed charge stock.

The total hydrocracked product effluent, introduced into reforming reaction zone 13 by way of line 12, without intermediate separation thereof, is initially at a temperature of about 970°F. The catalytic reforming system, although illustrated as a single vessel, may in fact be a plurality of reaction zones wherein the endothermic nature of the reactions is compensated via interheating between zones. Other operating conditions include a pressure of about 180 psig., a liquid hourly space velocity of about 1.25 and a hydrogen to hexane-plus hydrocarbon mole ratio of about 8:0:1.0. The hydrogen/hydrocarbon mole ratio has been diminished somewhat as a result of the hydrogen consumed in hydrocracking reactor 9.

The reforming catalyst is a composite of alumina, 0.75% by weight of chloride, 0.20% by weight of germanium and about 0.60% by weight of platinum. The catalytically reformed product effluent is withdrawn from reaction zone 13 by way of line 3, is utilized as a heat-exchange medium in heat-exchanger 2 and, following additional cooling to a temperature of about 95°F., is introduced into cold separator 6 by way of line 14. As hereinbefore set forth, a hydrogen-rich recycle gas stream is withdrawn by way of line 5 and combined with the fresh feed charge stock from line 4. The principally liquid product effluent is withdrawn by way of line 15 and sent to suitable separation facilities to recover a pentane-plus, normally liquid product effluent, a propane concentrate, a butane concentrate and, if desired, a pentane/hexane concentrate. Vent hydrogen-rich gas is discharged through line 16 by way of pressure control. Properties and yields of the reformed product effluent, including pentane and hexane, based upon fresh feed charge stock to hydrocracking reactor 9, are presented in the following Table II:

TABLE II

| Reformate Yields and Properties | | |
|---|---|---|
| Component | Wt.% | Vol.% |
| Hydrogen | 1.3 | — |
| Methane/Ethane | 3.1 | — |
| Propane | — | 8.5 |
| Isobutane | — | 13.2 |
| N-butane | — | 4.5 |
| Isopentane | — | 14.5 |
| N-pentane | — | 4.6 |
| Hexane-plus | — | 54.5 |
| Properties of pentane-Plus | | |
| Specific Gravity | | .772 |
| Research Octane Rating | | 96 |
| 100 ml. Distillation, °F. | | |
| I.B.P. | | 117 |
| 10% | | 138 |
| 30% | | 162 |
| 50% | | 195 |
| 70% | | 236 |
| 90% | | 278 |
| End Point | | 322 |

Considering only the pentane-plus portion of the product effluent, the same is produceed in an amount of about 73% by volume, and has a research octane rating, without the addition of lead compounds, of about 96. It should further be noted that the end point of the product effluent is only 322°F., which is advantageous in view of the fact that consideration is being given throughout the industry to effect a decrease in the end point of marketable motor fuel. The mixed butanes can be partially dehydrogenated to produce butylenes which may be subsequently alkylated with unconverted isobutanes to produce a $C_4$-alkylate of known octane rating. Similarly, the propane may be utilized as a starting material for isopropyl alcohol, or may also be subjected to dehydrogenation and alkylation to produce a $C_3$-alkylate of good octane rating.

This example illustrates the application of the concept of the present combination to certain specific compatible catalysts in the hydrocracking and catalytic reforming zones. However, in a broad sense, the inventive concept is applicable to other hydrocracking and reforming catalysts provided they are compatible—i.e., they can function in a low-pressure, series-flow fashion with substantially the same catalytic reaction atmosphere prevailing in both zones and without separation of components between zones.

The foregoing illustrates the method by which the present combination is effected and the benefits afforded through the utilization thereof.

I claim as my invention:

1. In a process for the production of a high octane motor fuel which comprises the steps of:

a. hydrocracking naphtha boiling range hydrocarbons containing cyclic components including aromatics with hydrogen, in a first reaction zone, in contact with a first catalytic composite of a Group VIII noble metal component and a zeolitic aluminosilicate carrier material and at a temperature in the range of about 350°F. to about 800°F. and a pressure from about 100 to about 700 psig. which is conducted adiabatically and therefore has a marked propensity for a high temperature runaway;

b. reacting the resulting first reaction zone effluent without intermediate separation thereof, in a second reaction zone, in contact with a second catalytic composite comprising platinum and alumina, at a temperature in the range of about 800°F. to about 1100°F. and at a pressure of from about 100 to about 700 psig; and, c. recovering said high octane motor fuel from the resulting second reaction zone effluent;

the method of maintaining the over-all exothermic temperature increase in said first reaction zone at a relatively high value while preventing a runaway exothermic reaction, which method comprises:

1. employing a first reaction zone inlet temperature generally below the hydrocracking range but sufficient to promote exothermic hydrogenation of aromatics so that the induced temperature increase initiates a favorable hydrocracking rate; and,
2. employing a first reaction zone outlet pressure favoring sufficient endothermic dehydrogenation of naphthenes to aromatics to prevent a run-away hydrocracking situation.

2. The method of claim 1 further characterized in that said first catalytic composite contains a palladium component, in an amount of 0.01% to about 2.0% by weight, calculated as the elemental metal.

3. The method of claim 1 further characterized in that said first catalytic composite contains a platinum component, in an amount of 0.01% to about 2.0% by weight, calculated as the elemental metal.

4. The method of claim 1 further characterized in that the maximum temperature in said first reaction zone is in the range of 600°F. to about 750°F.

5. The method of claim 1 further characterized in that said carrier material comprises mordenite.

6. The method of claim 5 further characterized in that said mordenite has a silica to alumina mole ratio from 12.0 to about 30.0.

7. The method of claim 1 further characterized in that said carrier material comprises mordenite distributed within an amorphous alumina matrix.

* * * * *